United States Patent [19]

Guckenheimer

[11] Patent Number: 4,894,022

[45] Date of Patent: Jan. 16, 1990

[54] SOLDERLESS SURFACE MOUNT CARD EDGE CONNECTOR

[75] Inventor: Peter U. Guckenheimer, Campbell, Calif.

[73] Assignee: Hewlett-Packard Company, Palo Alto, Calif.

[21] Appl. No.: 225,679

[22] Filed: Jul. 28, 1988

[51] Int. Cl.[4] ..... H01R 13/193; H01R 23/70

[52] U.S. Cl. ..... 439/260; 439/327; 439/635

[58] Field of Search ..... 439/59-62, 439/259, 260, 263, 264, 267, 68-73, 327, 635

[56] References Cited

U.S. PATENT DOCUMENTS

| | | | |
|---|---|---|---|
| 3,248,779 | 5/1966 | Yuska et al. | 439/68 |
| 3,868,162 | 2/1975 | Ammon | 439/678 |
| 3,920,302 | 11/1975 | Cutchaw | 439/260 |
| 3,980,376 | 9/1976 | Rosen | 439/327 |
| 4,221,448 | 9/1980 | Logerot et al. | 439/260 |

*Primary Examiner*—Neil Abrams

*Attorney, Agent, or Firm*—Alan H. Haggard

[57] ABSTRACT

A solderless surface mount card edge connector is presented. In one embodiment, a connector is attached to a printed circuit board 53. The connector includes a plurality of contacts and extrusions. A daughter board includes a rigid portion on which are attached a series of fingers. When the rigid portion of the daughter board is placed within the connector, the plurality of contacts are pressed downward and establish electrical contact with electrical regions on the mother board. Also, the downward force is transferred by the contacts into horizontal pressure so that electrical contact is established between the plurality of contacts and the series of fingers. In order to maintain the pressure two metal threaded spacers are pinned to the daughter board and fastened to the mother board via screws. Once tightened the assembly is protected from dislodging, even under vibration. The downward pressure, and thus electrical contact, is maintained. The screws may be undone to separate the mother board from the daughter board.

15 Claims, 27 Drawing Sheets

SOLDERLESS SURFACE MOUNT CARD EDGE CONNECTOR

BACKGROUND

The present invention relates to electro-mechanical connection between two printed circuit boards, between a cable and a printed circuit board, and between an integrated circuit and a printed circuit board.

Typically, when solderless electro-mechanical connection between two printed circuit boards is sought, "daughter" circuit boards are electro-mechanically connected to a "mother" board as shown in FIG. 1. In FIG. 1 a daughter board 9 includes a series of electrically conductive fingers 8 on a cut out section 7 of daughter board 9. Section 7 with fingers 8 are inserted into an edge connector 15 which is attached to a mother board 10.

In FIG. 2A, a cross-section of edge connector 15 is shown. Contacts 13 and 14 of edge connector 15 are shown soldered to mother board 10 at joints 11 and 12 respectively. Contacts 13 and 14, are configured for surface mount connection onto mother board 10. Contacts 13 and 14 form one of many pairs of contacts in edge connectors 15. All the pairs of contacts of edge connector 15 are covered by a shell 17, typically made of high temperature plastic. Fingers 16 on from fingers 8 are shown ready to be inserted between contacts 13 and 14.

In FIG. 2B, section 7 with fingers 8 of daughter board 9 have been inserted into edge connector 15. Contacts 13 and 14 are shown to have been bent to make room for the insertion of section 7 and fingers 16. The spring action of contacts 13 and 14 provide electro-mechanical contact between contacts 13 and 14 and fingers 16.

In FIG. 2C, instead of a surface mount connection, contacts 13 and 14 have been placed through circuit board 10 and soldered at points 18 and 19.

An alternate prior art embodiment of edge connector 15 is shown in FIG. 3. A single contact 33 is bent as shown and soldered to mother board 10 at joints 31 and 32. When section 7 with fingers 8 of daughter board 9 is inserted into edge connector 15, contact 33 expands to receive section 7 and fingers 16, as shown in FIG. 4. The spring force of contact 33 attempting to contract to its original position establishes electro-mechanical connection between contact 33 and fingers 16.

The prior art connectors shown have a number of drawbacks. For instance, the spring action used to hold section 7 and fingers 8 to edge connector 15, may provide an unreliable mechanical bond. Further the soldering required in each of the prior art embodiments, which use surface mount technology, lessens the reliability of the connection because of thermal expansion and contraction which takes place during soldering and usage. Also, mechanical installation may weaken and/or fracture the solder bonds.

SUMMARY OF THE INVENTION

In accordance with the preferred embodiments of the present invention a solderless surface mount card edge connector is presented. In one embodiment, a connector is attached to a mother board. The connector includes a plurality of contacts held on an extrusion. A daughter board includes a rigid portion on which are laid a series of fingers. When the rigid portion of the daughter board is placed within the connector, the plurality of contacts are pressed downward and establish electrical contact with electrical regions on the mother board. Also, the downward force is transferred by the contacts into horizontal pressure so that electrical contact is established between the plurality of contacts and the series of fingers. In order to maintain the pressure two metal threaded spacers are fastened, e.g., by pins, to the daughter board and the two metal threaded spacers are fastened to the mother board, e.g., via screws. Once tightened the assembly is protected from dislodging, even under shock or vibration. The downward pressure, and thus electrical contact, is maintained. The screws must be undone to separate the mother board from the daughter board.

In an alternate embodiment, exposed leads of a cable are attached to rigid board material. When the rigid board material and exposed leads are placed within the connector, the plurality of contacts are pressed downward and establish electrical contact with electrical regions on the mother board. Also, the downward force is transferred by the contacts into horizontal pressure so that electrical contact is established between the plurality of contacts and the exposed leads.

The present invention also may be adapted to provide connection between an integrated circuit and a printed circuit board.

DESCRIPTION OF THE PREFERRED EMBODIMENT

Figure 1:
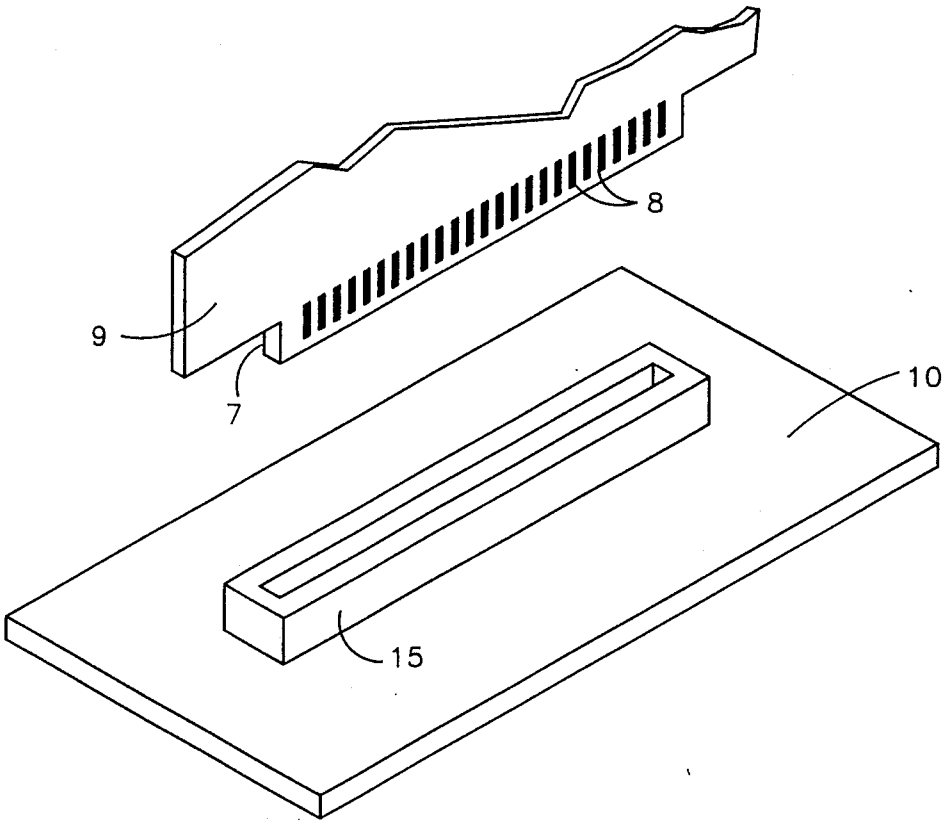
FIG 1 (PRIOR ART)
FIG. 1 shows a connector being used to electro-mechanically connect a daughter board to a mother board.
Figure 2A:
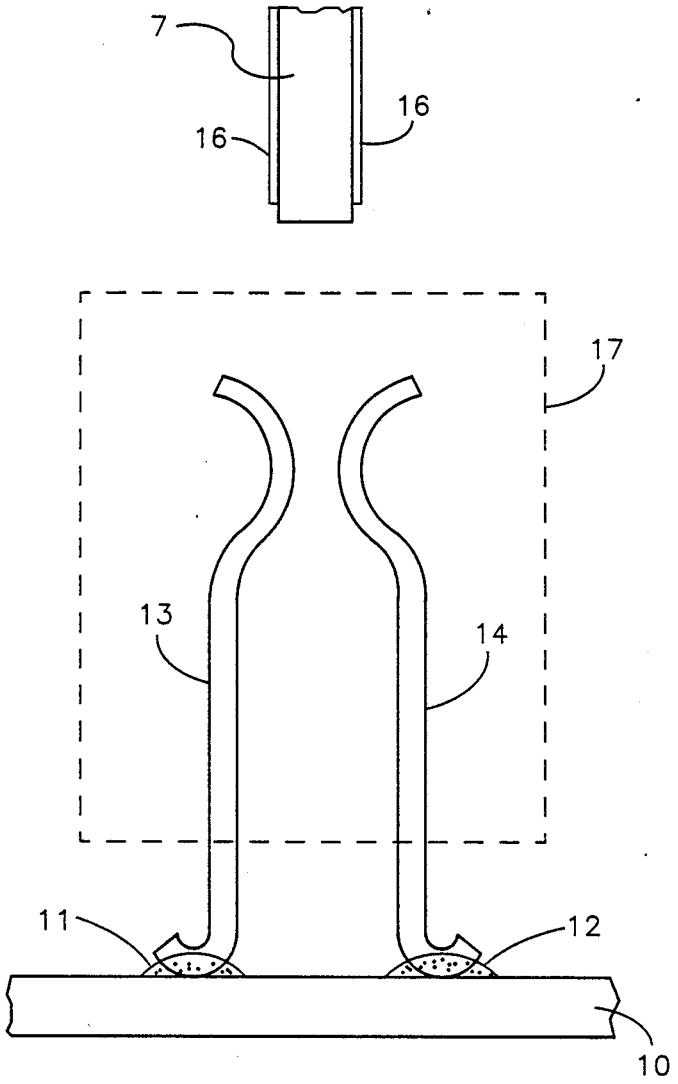
FIG 2A (PRIOR ART)
FIGS. 2A, 2B and 2C are cross-section views of a prior art embodiments of the connector shown in FIG. 1.
Figure 2B:
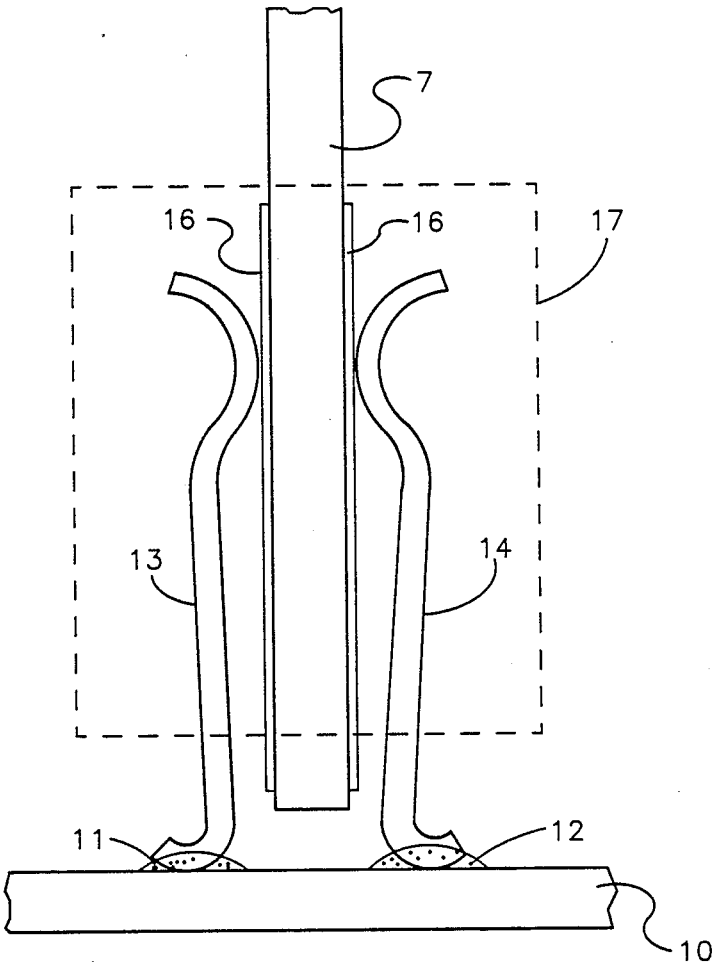
FIG 2B (PRIOR ART)
Figure 2C:
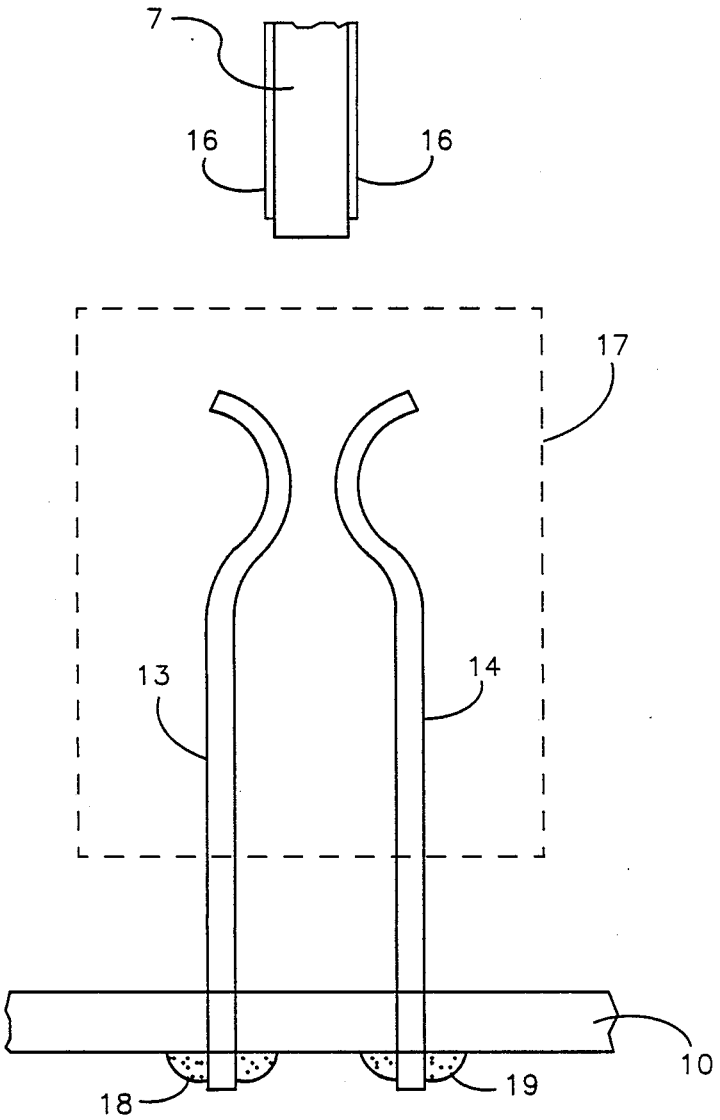
FIG 2C (PRIOR ART)
Figure 3:
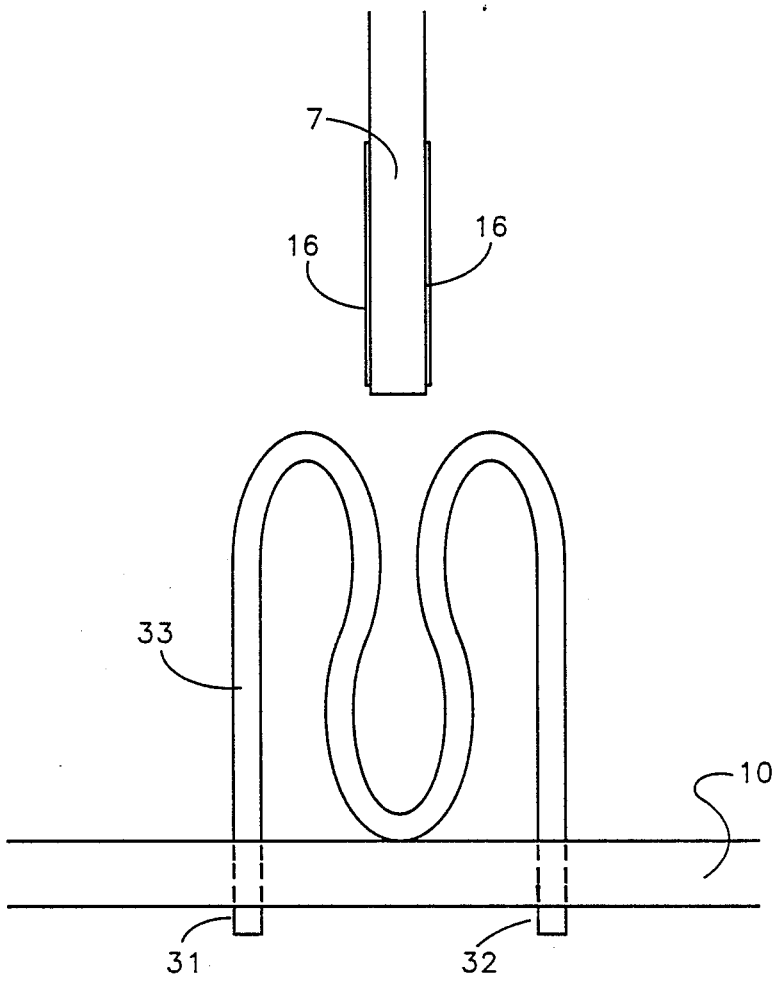
FIG 3 (PRIOR ART)
FIGS. 3 and 4 is a cross-section view of an alternate prior art embodiment of the connector shown in FIG. 1.
Figure 4:
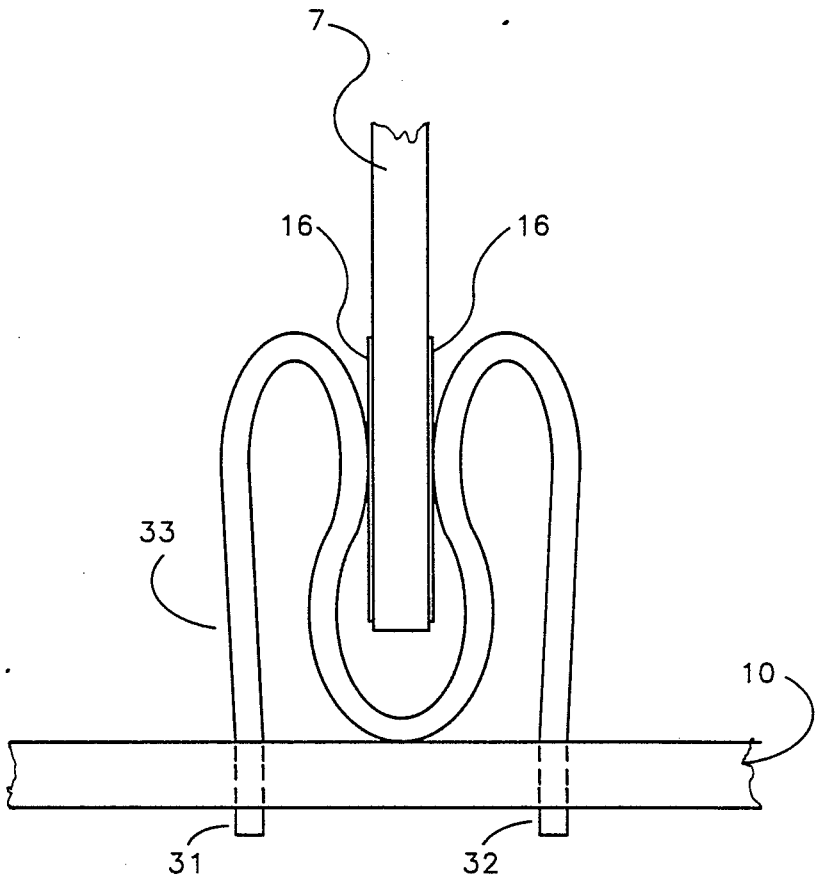
FIG 4 (PRIOR ART)
Figure 5:
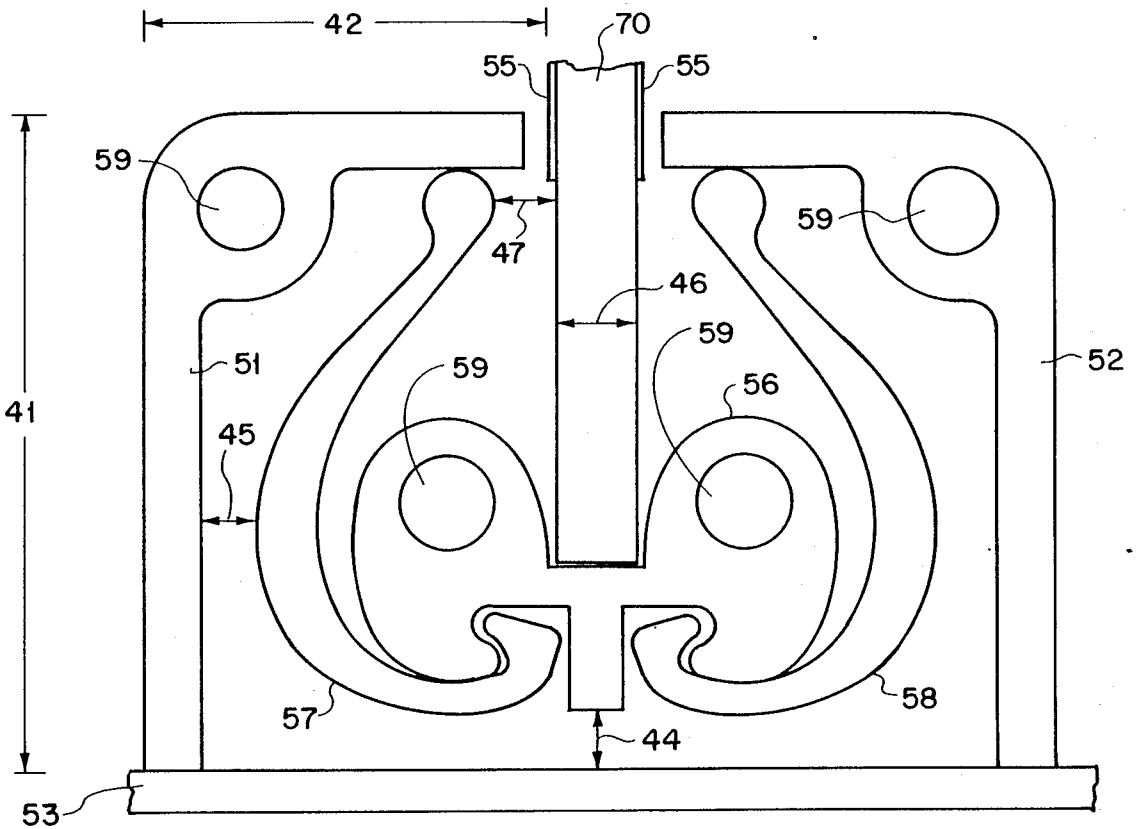
FIGS. 5 and 6 is a cross-sectional view of a connector in accordance with a preferred embodiment of the present invention.

FIG. 5 shows a cross-sectional view of a connector in accordance with a preferred embodiment of the present invention. A housing extrusion 51 and a housing extrusion 52, made of plastic or metal rest on top of a mother board 53. Housing extrusion 51 has a length 41 of approximately 0.5 inches and a width 42 of approximately 0.3 inches. A center extrusion 59 is made of plastic and holds a contact 57 and a contact 58 in place. Contact 57 and contact 58 are made of, for instance, beryllium copper. These are completely or selectively plated with gold or another noble metal. A section 70 of a daughter board 61 (shown in FIG. 7) on which fingers 55 are laid is shown in FIG. 5 to be inserted between housing extrusion 51 and housing extrusion 52 without placing any downward pressure on center extrusion 56. Pin holes 59 are used to hold extrusions 51, 52 and 56 in place. In the uncompressed position shown in FIG. 5, center extrusion 56 is a distance 44 from mother board 53. Distance 44 is, for example 0.025 inches. Contact 57 is a distance 45 from extrusion 51. Distance 45 is, for example 0.0375.

Figure 6:
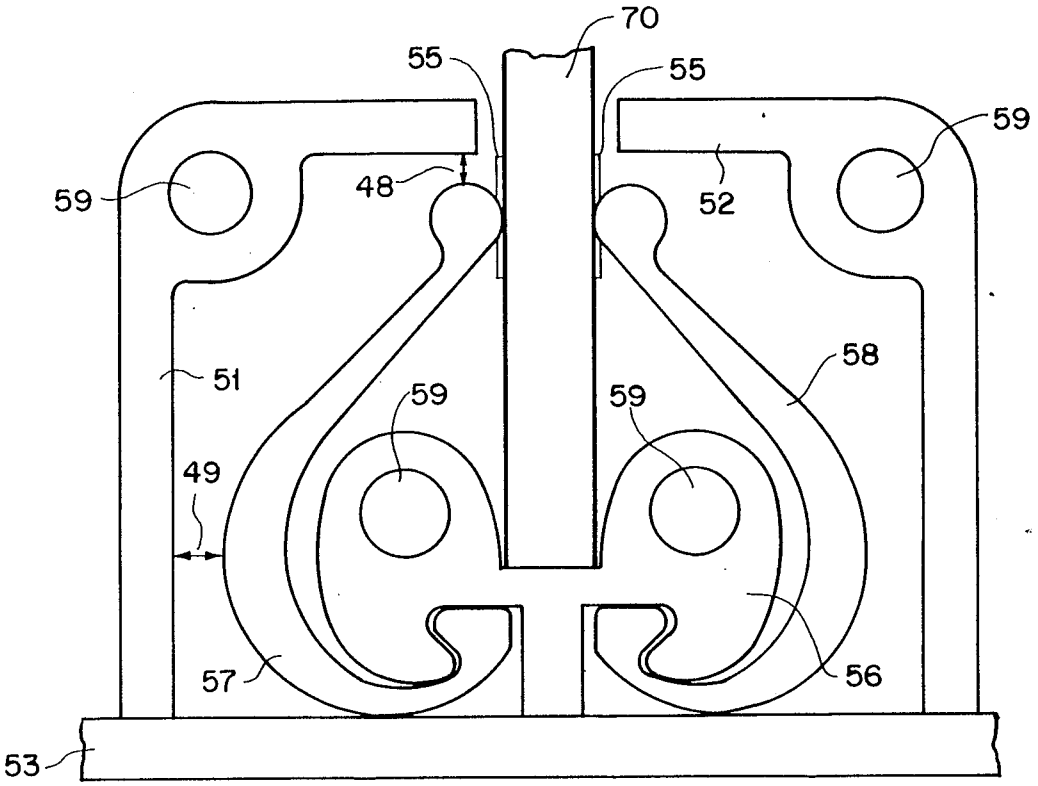

In FIG. 6, the connector shown in FIG. 5 is shown in compressed position. In FIG. 6, contact 56 is a distance 49 and a distance 48 from extrusion 51. Distance 49 is, for example, 0.0375 inches. Distance 48 is, for example, 0.025 inches.

Figure 7A:
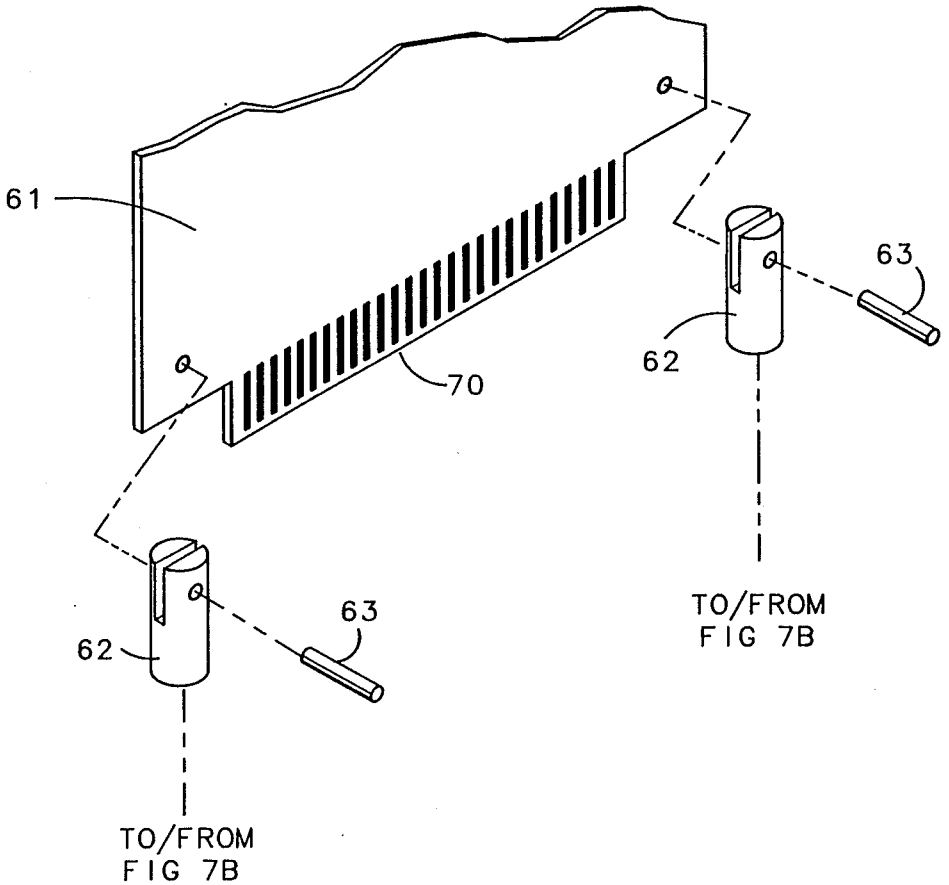
FIG. 7 shows an assembly of the connector shown in FIGS. 5 and 6 in accordance with a preferred embodiment of the present invention.
Figure 7B:
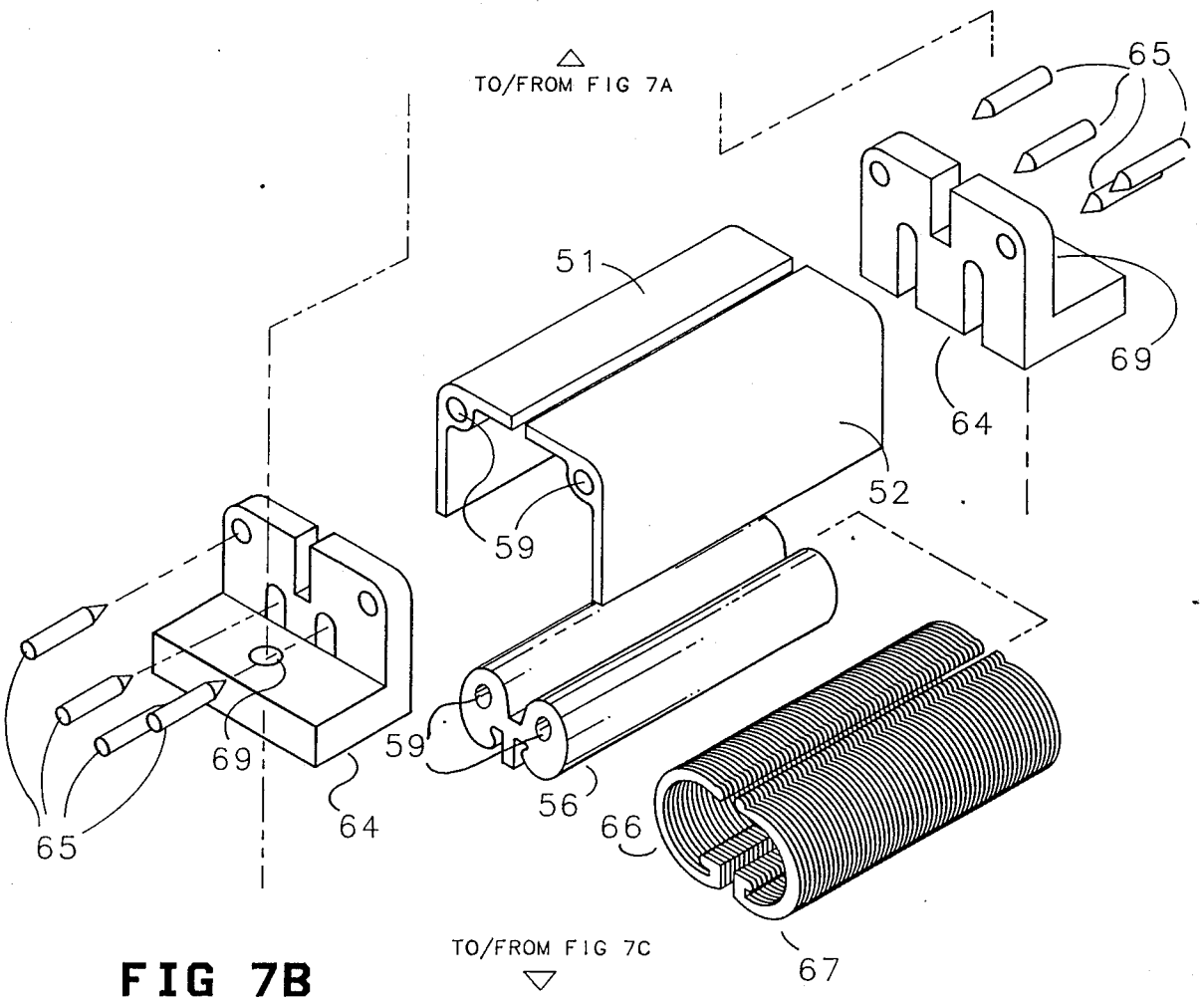
Figure 7C:
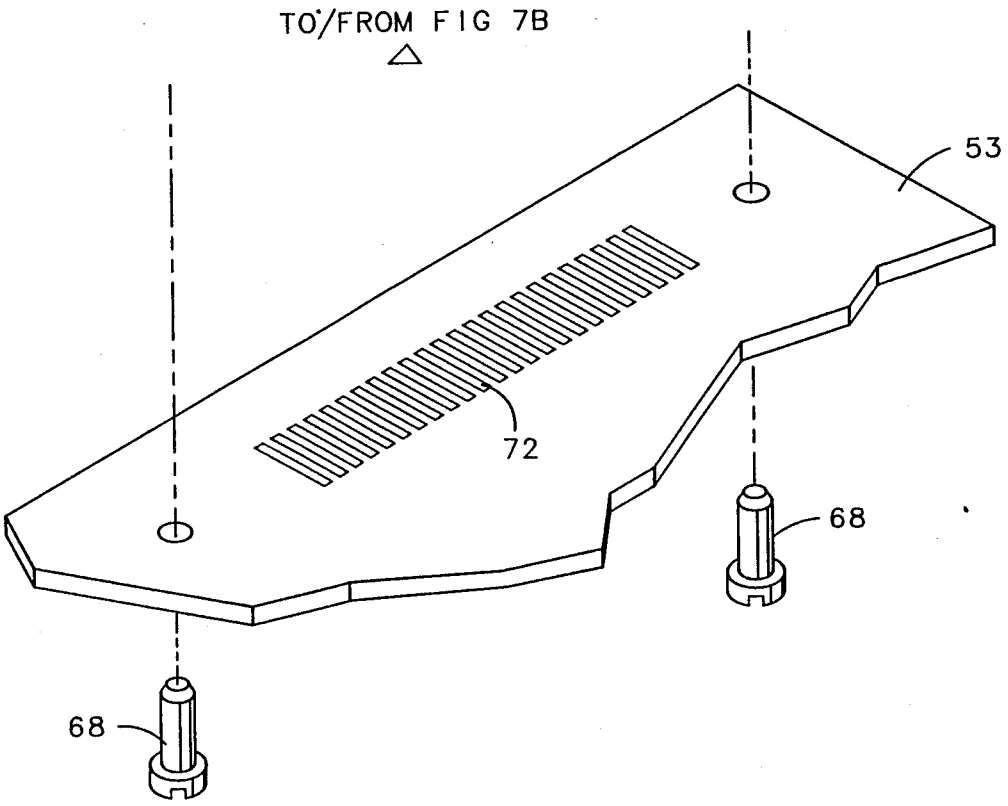

FIG. 7 shows how series of contacts 66 and 67 are assembled for contact between mother board 53 and section 70 of daughter board 61. Typically, series of contacts 66 and series of contacts 67 each include, for example, 20 contacts of 18–20 mils thickness arranged in series. Between each contact is an insulator, typically 0.0005–0.0025 inches thick, which serves to electrically insulate each contact from those contacts immediately adjacent. The insulator may be, for instance, a coating of plastic, paint or oxide applied to each contact on both sides. On section 70 is laid fingers 55. Fingers 55 are typically 0.018 inches wide. Series of contacts 66 includes contact 57, and series of contacts 67 includes contact 58.

As shown in FIG. 5, Extrusions 51, 52, made of metal or plastic, cover and protect the contacts from damage. An extrusion 56 provides support for series of contacts 66 and 67. L-blocks 64 are connected to extrusions 51, 52 and 56, for example, through the use of pins 65 placed through pin holes 59. Alternate fastening means, such as screws, could also be used. Daughter board 61 is mechanically connected to spacers 62 with the use of, for example, pins 63. Screws could be used instead of pins 63. Screws 68 attach through holes 69 of L-blocks 64 to engage threaded holes in spacers 62. When screws 68 are tightened, series of contacts 66 and 67 are in compressed position as demonstrated in FIG. 6.

Figure 8A:
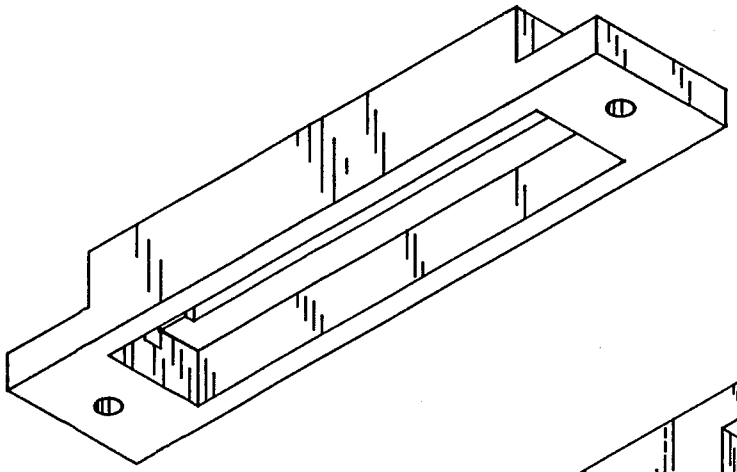
FIGS. 8A and 8B show an alternate housing for the connector shown in FIG. 7.
Figure 8B:
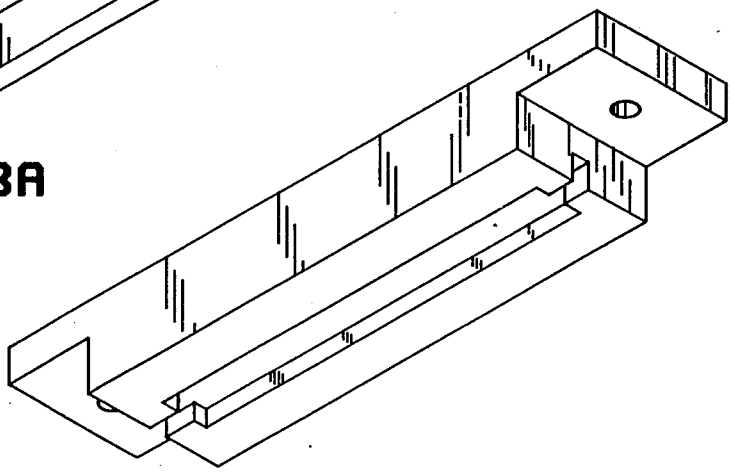

FIGS. 8A and 8B show an alternate embodiment where a single injection molded housing 81 may be used to replace extrusion 51, extrusion 52 and L-blocks 64. Alternately, housing 81 may be, for example, die cast metal.

Figure 9:
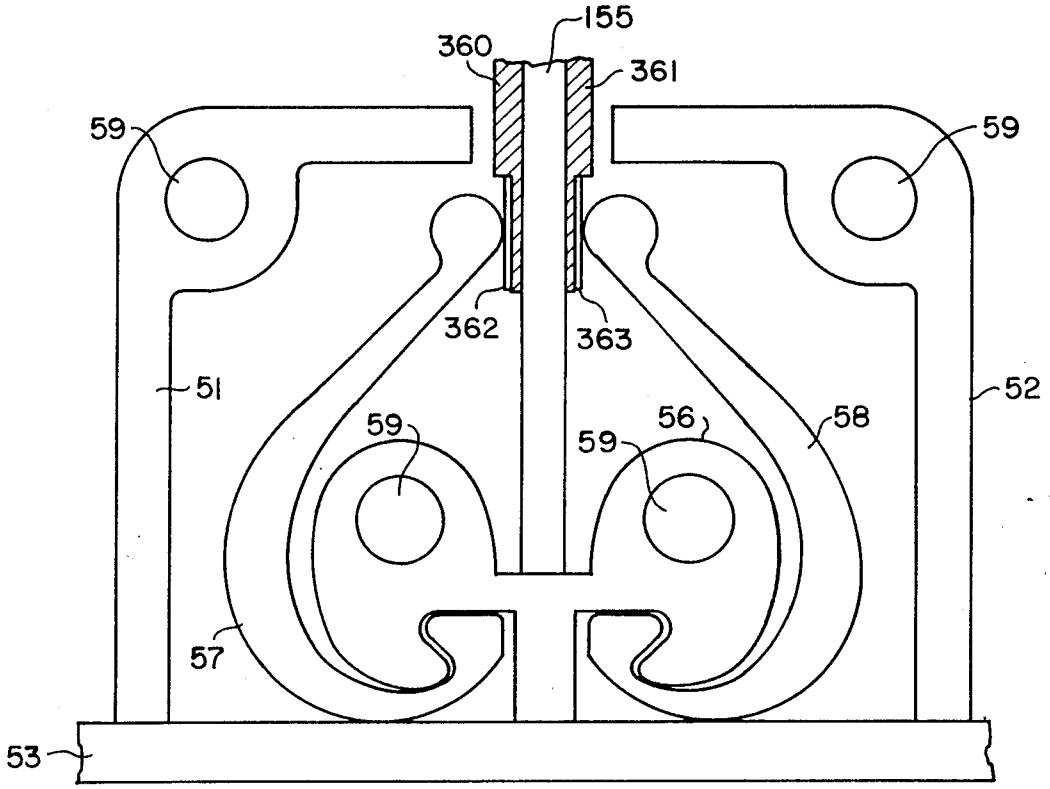
FIG. 9 is a cross-sectional view of the connector shown in FIGS. 5–7, as adapted to allow connection of a cable to a printed circuit board in accordance with a preferred embodiment of the present invention.

FIG. 9 shows how the connector shown in FIGS. 5–7 may be adapted to allow connection of a flat cable or flex circuit to a printed circuit board 53 in accordance with a preferred embodiment of the present invention. A cable 160 and a cable 361 are mounted on rigid board material 155. The insulation of cable 360 and 361 is removed over exposed leads 362 and 363 to allow for electrical contact between exposed lead 362 and contact 57, and between exposed lead 363 and contact 58. In the present invention, the pitch of connectivity is 0.025 inches. Any item that has the right pitch and thickness may be similarly electro-mechanically attached to printed circuit board 53.

Figure 10:
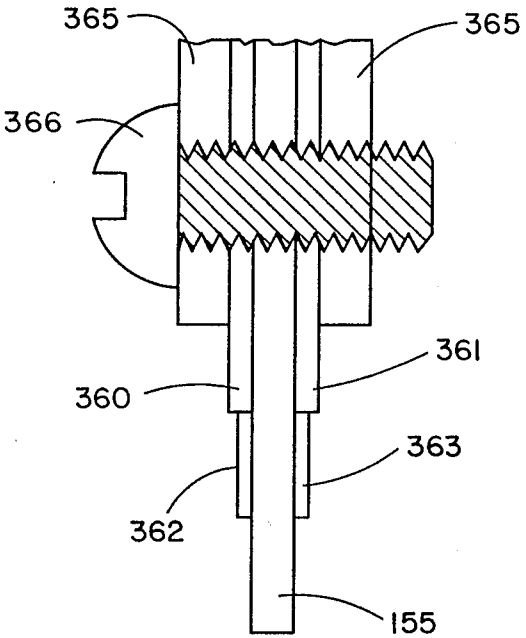
FIGS. 10 and 11 show further detail of the connector shown in FIG. 9.

In FIG. 10, flex cables 360 and 361 are shown held to rigid board material 155 through the use of holding clamp members 365 and a screw 366.

Figure 11:
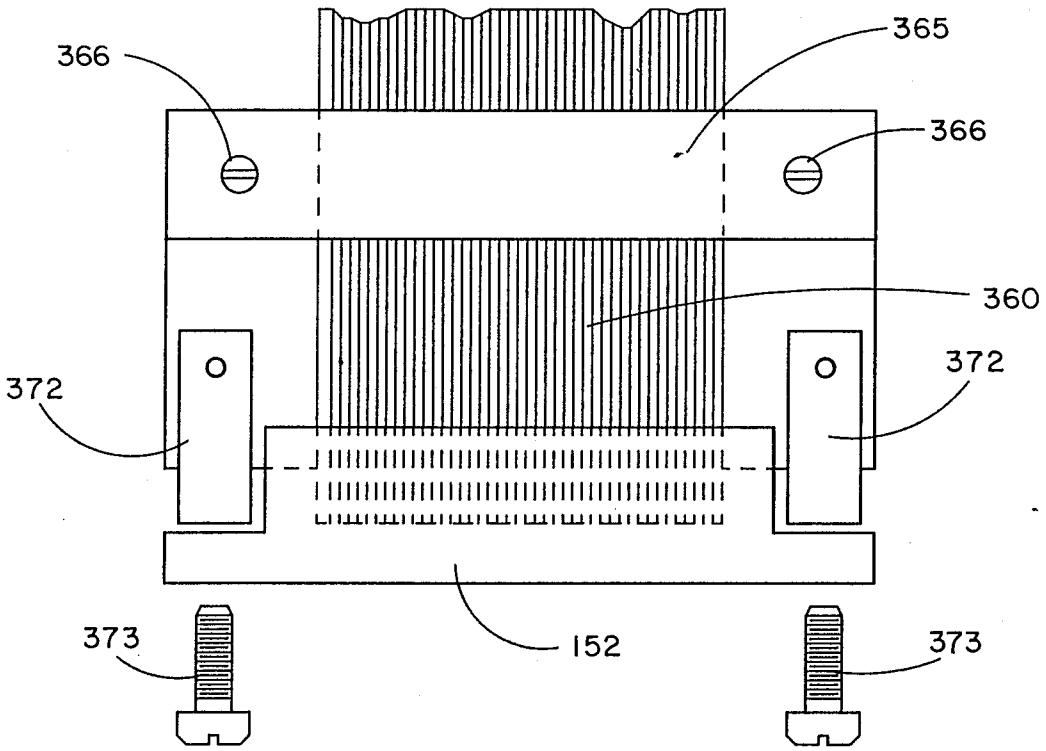

In FIG. 11, flex cable 360 is shown coupled to connector housing 152 through the use, for example, of spacers 372 and screws 373.

Figure 12:
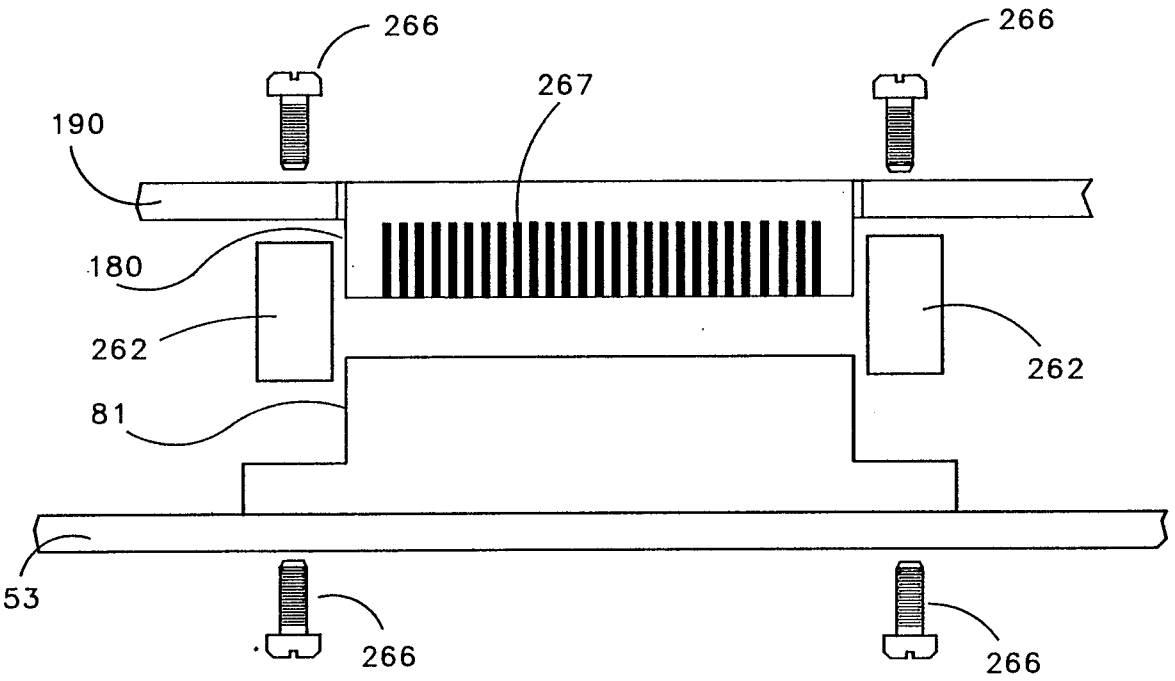
FIG. 12 shows the connector of FIG. 7 used to electro-mechanically connect two parallel printed circuit boards.

FIG. 12 shows how fingers 267 of a circuit board 190 may be electro-mechanically connected to a connector on circuit board 53 in accordance with a preferred embodiment of the present invention. Fingers 267 are laid onto a section 180 of circuit board 190 which is bent or molded downward 90 degrees. Section 180 also, for example, may be a separate add-on to circuit board 190. Section 180 with fingers 267 are placed through extrusion 81. Circuit board 190 and 53 may be mechanically coupled together, for example through screws 266 screwed into spacers 262, as shown.

Figure 13:
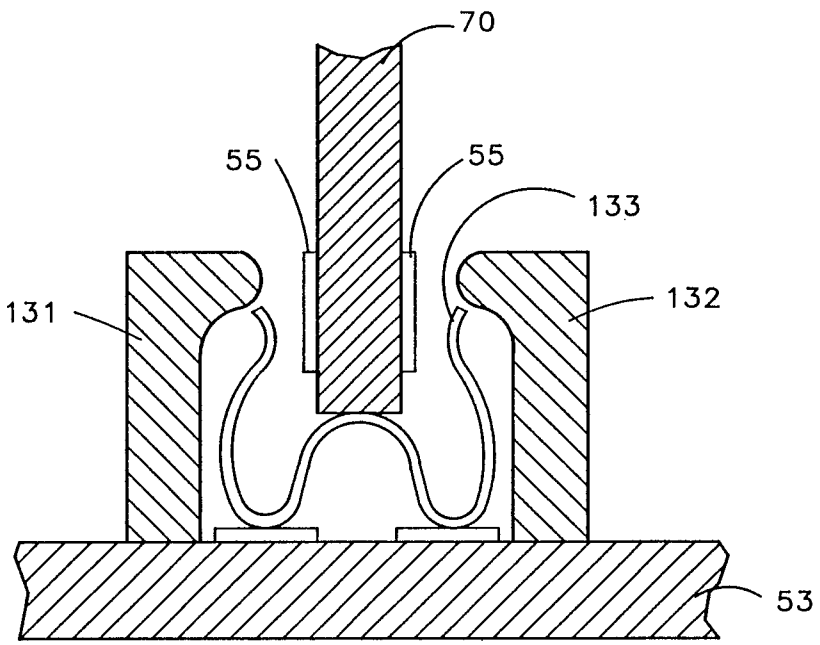
FIGS. 13 and 14 show an alternate embodiment of the connector shown in FIGS. 5 and 6.
Figure 14:
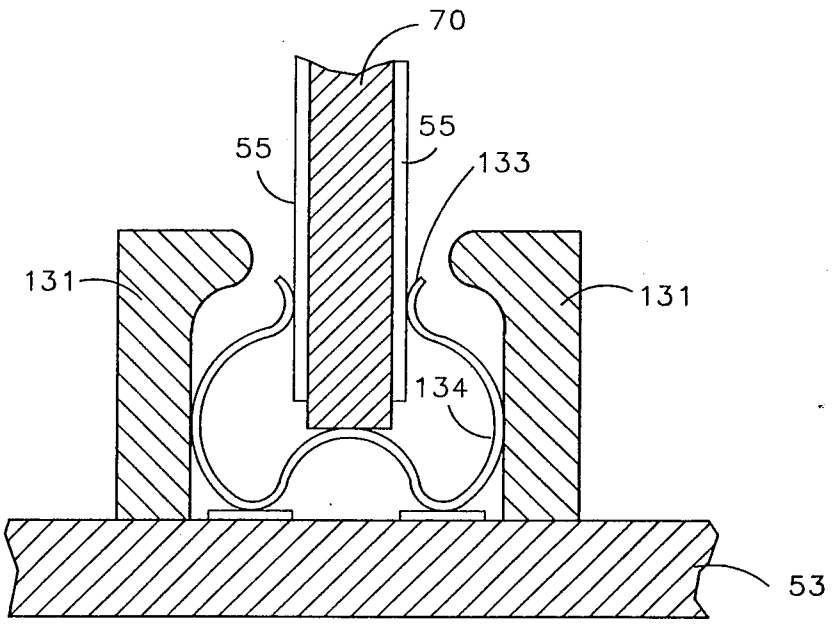

In FIG. 13 an alternate embodiment of a connector is shown. A contact 133 is held in place by a molded housing 131 and 132 coupled to mother board 53. Section 70 of printed circuit board 61 on which is laid fingers 55 is shown touching contact 133 but putting no pressure upon contact 133. FIG. 14 shows contact 133 in its fully engaged position caused by downward pressure from section 70 of circuit board 61.

Figure 15:
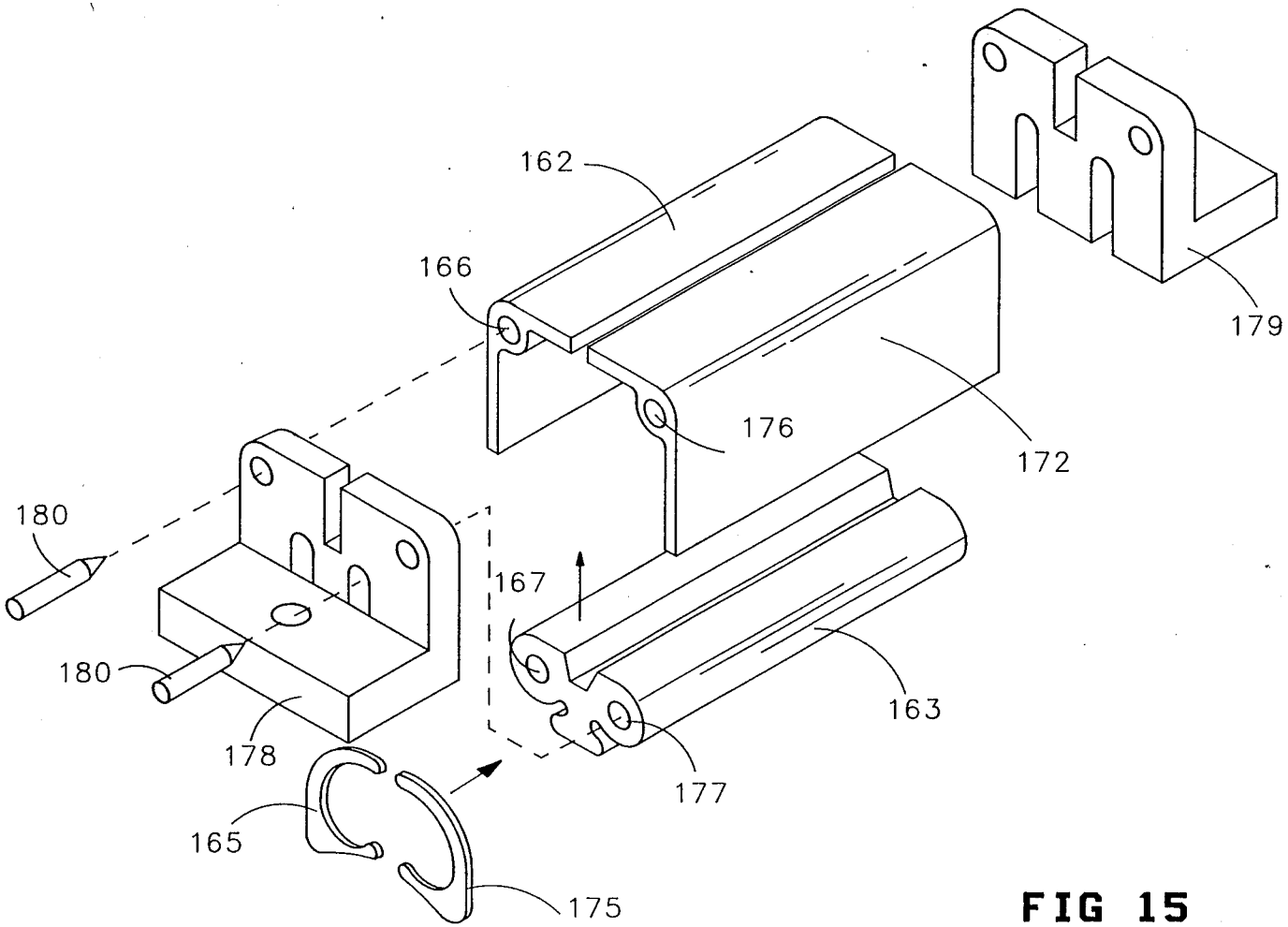
FIGS. 15, 16 and 17 show another alternate embodiment of the connector shown in FIGS. 5 and 6.

In FIG. 15, an assembly using an alternate embodiments of contacts is shown. Pins 180, for example, may be used to fasten L-blocks 178 and 179 to extrusions 162, 172 and 163. Pins are placed through a pin hole 166 of extrusion 162, a pin hole 176 of extrusion 172 and pin holes 167 and 177 of extrusion 163. Contacts are placed upon extrusion 163 as shown. Although 20 or more contacts may be placed on each side of extrusion 163, only contacts 165 and 174 are shown in FIG. 16.

Figure 16:
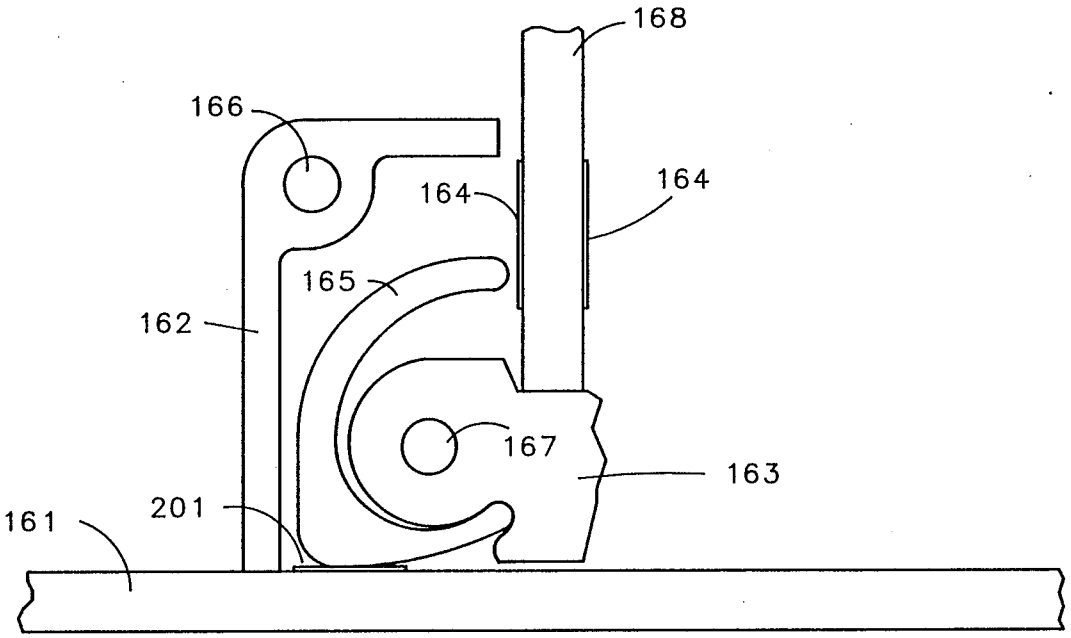

In FIG. 16 contact 165 is shown in an uncompressed position, resting on an electrically conductive region 201 of printed circuit board 161. A section 168 of a daughter printed circuit board is shown resting against extrusion 163, although there is no downward pressure. Fingers 164 are laid on section 168.

Figure 17:
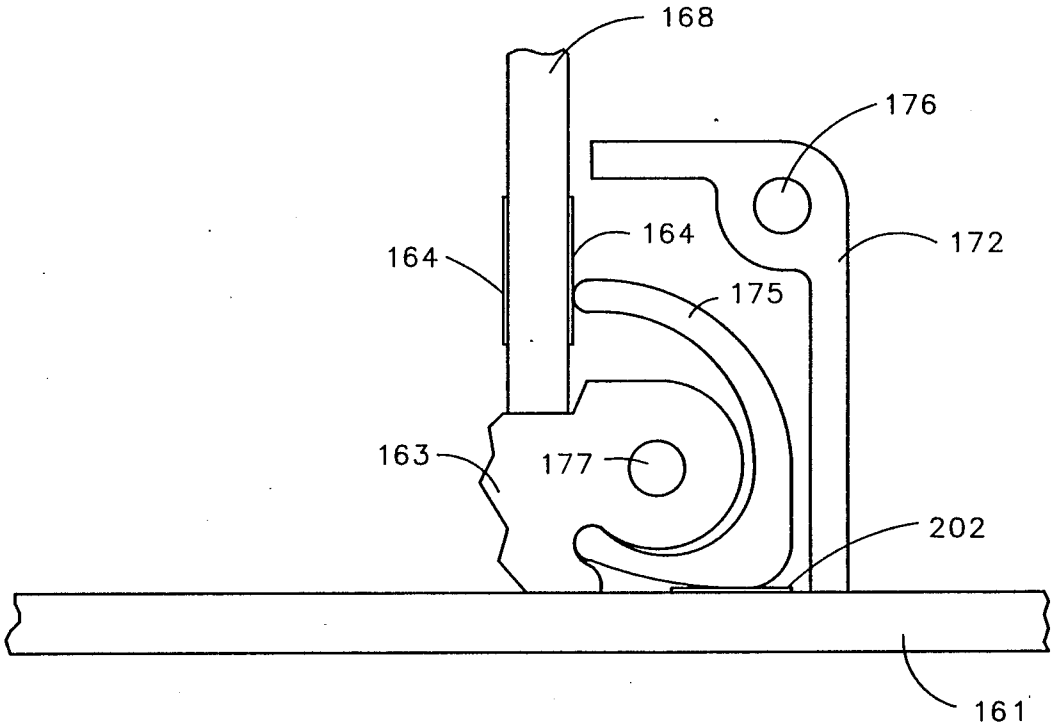

In FIG. 17, contact 175 is shown in compressed position. In compressed position electrical contact is made between fingers 164 and an electrical region 202 on printed circuit board 161.

Figure 18:
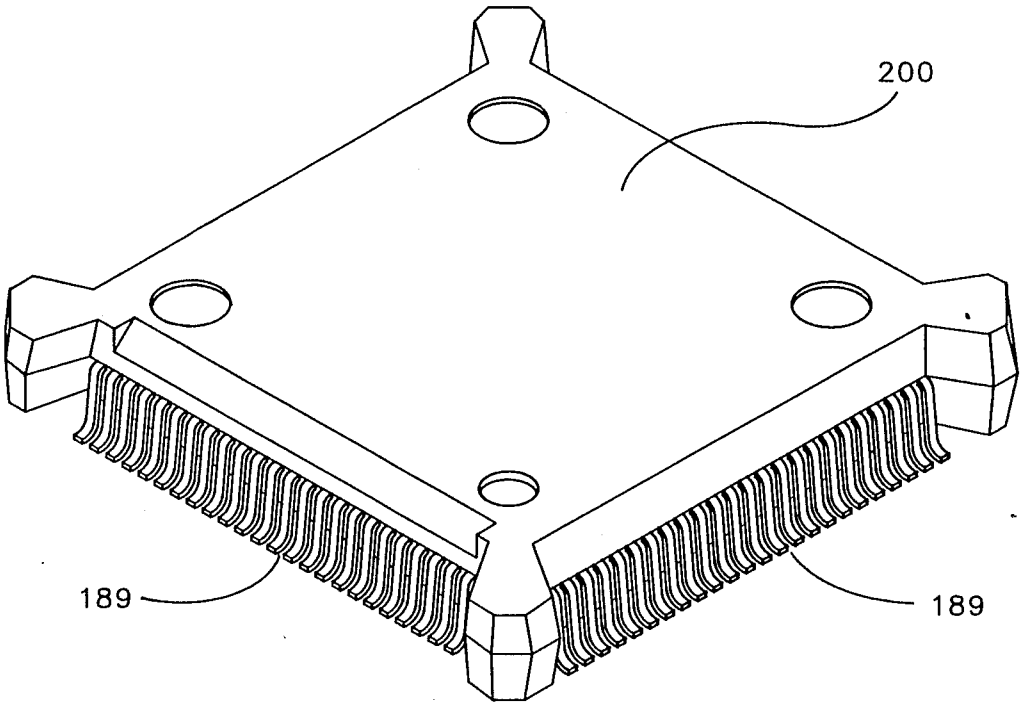
FIG. 18 shows an integrated circuit.
Figure 19:
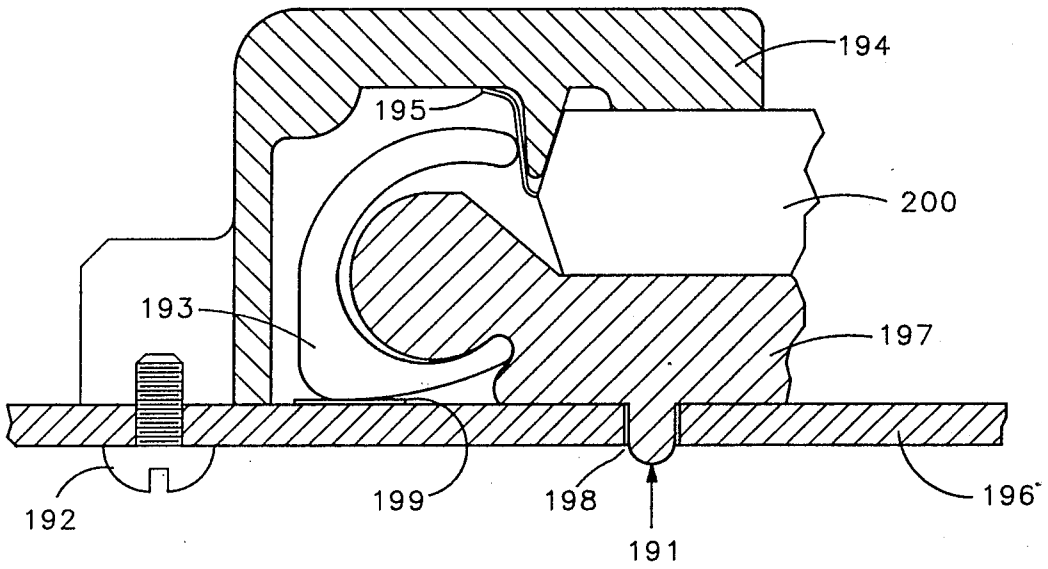
FIGS. 19 and 20 shows an embodiment of the present invention adapted to provide connection between a printed circuit board and the integrated circuit shown in FIG. 18.

In FIG. 18 is shown an integrated circuit 200 with leads 189. Typically, in the prior art surface mount technology leads 189 of integrated circuit 200 are soldered to a printed circuit board. In FIG. 19, it is shown how leads 189 of integrated circuit 200 may be electrically connected to electrically conductive regions of a printed circuit board 196 without soldering.

A plastic molded housing 197 is placed onto printed circuit board 196. Nobs, for instance a nob 191, of plastic molded housing 197 are placed through holes, for instance a hole 198, of printed circuit board 196 to insure proper alignment. Integrated circuit 200 is placed upon plastic molded housing 197. A lead 195 is one of leads 189. In the shown embodiment, integrated circuit 200 has been rotated vertically 180 degrees from the orientation shown in FIG. 18. Thus leads 189, (represented in FIG. 20 by lead 195) are pointing up in FIG. 20 (verses down in FIG. 19). A series of contacts establish electrical contact between leads 189 and electrical regions on printed circuit board 196. For instance a contact 193 is shown providing electrical connection between lead 195 and an electrically conducting regions 199 on printed circuit board 196. A top member 194 is used to provide downward pressure on integrated circuit 200, thus causing contact 193 to be in the compressed position. The materials and patterns of top member 194 may be selected so that top member 194 also acts as a heat sink and radio-frequency interference (RFI) shielding for circuitry of integrated circuit 200, since as may be seen contact 195 comes into contact with top member 194. Top member 194 is fastened to printed circuit board 196, for instance, by a screw 192. Top member 194 may be made of anodized aluminum or may be a conductive metal with a thin insulation material added.

Figure 20:
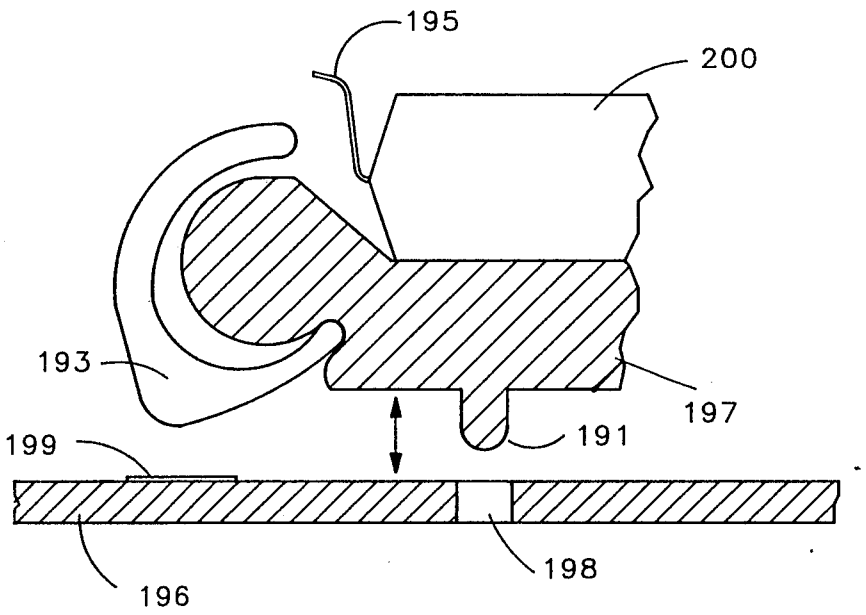

In FIG. 20, molded plastic housing with integrated circuit 200 and contact 93 is shown lifted off of printed circuit board 196.

Figure 21:
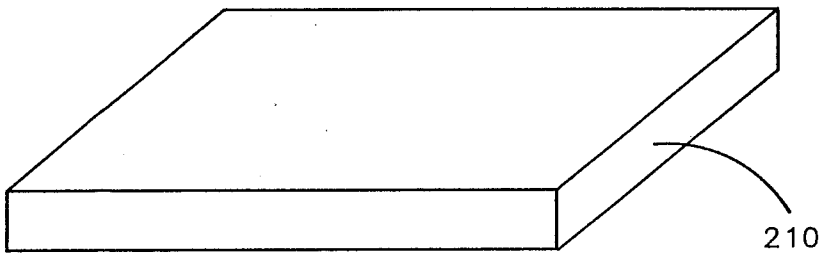
FIGS. 21–23 shows insulator being added to conductive contact material in order to manufacture contacts in accordance to the preferred embodiment of the present invention.

In FIG. 21 a sheet 210 of, for example, beryllium copper is shown ready for the application of an insulator.

Figure 22:
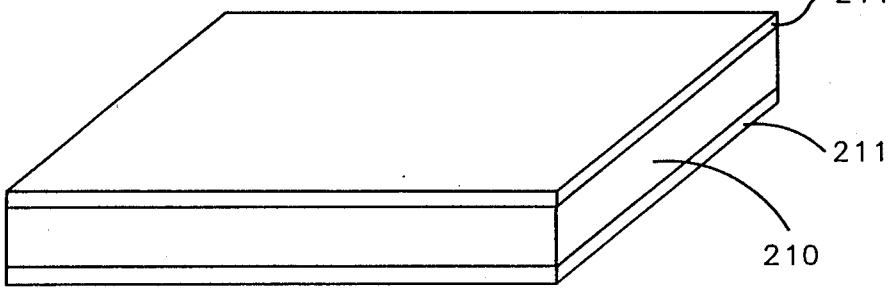

In FIG. 22, sheet 210 has been coated on both sides by insulating layers 211. Insulating layers 211 may be, for instance, plastic, paint or oxide material.

Figure 23:
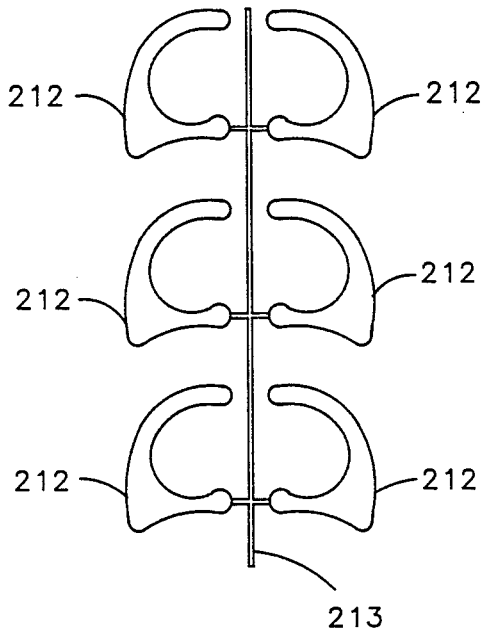

In FIG. 23, a strip form 213 which includes contacts 212 has been stamped out of sheet 210. Insulating layers 211 remain over the top and bottom of strip form 213, but the edges of each contact 212 are exposed beryllium. Strip form 213 may be plated with gold or another noble metal on the exposed edges of contacts 212 which are not insulated. The insulation acts as a mask for plating.

The insulating allows the contacts to be stacked side by side on an extrusion or on plastic housing without the use of slot walls.

I claim:

1. A connector for providing electro-mechanical connection between a first printed circuit board and a second printed circuit board, the connector comprising:

a spring connector portion including, a plurality of contacts, electrically insulated from one another, the contacts being adjacent to electrically conducting regions of the first printed circuit board, and support means (56,163,131,132), mechanically coupled to the first printed circuit board, for holding the contacts in a predetermined unsprung position;

a plurality of fingers laid on a first portion of the second printed circuit board, the first portion of the second printed circuit board being inserted into the spring connector portion; and attachment means, coupled to the first printed circuit board and the second printed circuit board, for attaching the first printed circuit board to the second printed circuit board in a fully engaged position;

wherein the plurality of contacts, the support means and the plurality of fingers are arranged so that when the attachment means places the first printed circuit board and the second printed circuit board in the fully engaged position the first portion of the second printed circuit board places pressure on the plurality of contacts so that each contact from the plurality of contacts is pressed downward onto an electrically conducting region from the electrically conducting regions of the first printed circuit board at a pivot point on the contact, the contact pivoting around the pivot point thereby converting the downward pressure into horizontal pressure horizontally pressing the contacts to the plurality of fingers and thus establishing electrical contact between the contacts and the electrically conducting regions and between the contacts and the fingers.

2. A connector as in claim 1, wherein:

the support means comprises a first extrusion extending perpendicular to the first printed circuit board, and a second extrusion extending perpendicular to the first printed circuit board; and, each contact comprises, a first curved region upon which the rigid board material applies downward pressure when the apparatus is in the fully engaged position;

a second curved region, coupled to the first curved region, which rests upon an electrically conducting region of the first printed circuit board when the apparatus is in the fully engaged position;

a third curved region, coupled to the first curved region, which rests upon an electrically conducting region of the first printed circuit board when the apparatus is in the fully engaged position;

a fourth curved region, coupled to the second curved region, which rests against the first extrusion;

a fifth curved regions, coupled to the third curved region, which rests against the second extrusion, a sixth curved region, coupled to the fourth curved region, which, when the printed circuit board and the second printed circuit board are in the fully engaged position, rests against a finger from the plurality of fingers; and, a seventh curved region, coupled to the fifth curved region, which, when the first printed circuit board and the second printed circuit board are in the fully engaged position, rests against a finger from the plurality of fingers.

3. A connector as in claim 1 wherein:

the support means comprises a first extrusion, the first extrusion being in contact with the first portion of the second printed circuit board when the first printed circuit board and the second printed circuit board are in the fully engaged position; and, the plurality of contacts is divisible into pairs of contacts, each pair of contacts comprising a first contact including a first region which is pressed by the third extrusion when the first printed circuit board and the second printed circuit board are in the fully engaged position, a second region, coupled to the first region which is in contact with an electrically conducting region of the first printed circuit board when the first printed circuit board and the second printed circuit board are in the fully engaged position, a third region, coupled to the second region, and a fourth region, coupled to the third region, which, when the first printed circuit board and the second printed circuit board are in the fully engaged position, rests against a finger from the plurality of fingers, and a second contact including a first region which is pressed by the third extrusion when the first printed circuit board and the second printed circuit board are in the fully engaged position, a second region, coupled to the first region of the second contact, the second region of the second contact being in contact with an electrically conducting region of the first printed circuit board when the first printed circuit board and the second printed circuit board are in the fully engaged position, a third region, coupled to the second region of the second contact, and a fourth region, coupled to the third region of the second contact, the fourth region of the second contact resting against a finger from the plurality of fingers, when the first printed circuit board and the second printed circuit board are in the fully engaged position.

4. A connector as in claim 1 wherein the plurality of contacts are insulated from each other by means of a coat of insulating material placed on portions of each contact in the plurality of contacts.

5. A connector for providing electro-mechanical connection between a first printed circuit board and an apparatus, the apparatus having a plurality of exposed leads, wherein the connector comprises:

a spring connector portion including, a plurality of contacts, electrically insulated from one another, the contacts being adjacent to electrically conducting regions of the first printed circuit board, and support means (56,163,197,131,132), mechanically coupled to the first printed circuit board, for holding the contacts in a predetermined unsprung position;

rigid board material coupled to the plurality of exposed leads, the rigid board material and the plurality of exposed leads being inserted into the spring connector portion; and attachment means, coupled to the first printed circuit board and the apparatus, for attaching the first printed circuit board to the apparatus in a fully engaged position;

wherein the plurality of contacts, the support means, the rigid board material and the plurality of exposed leads are arranged so that when the attachment means places the first printed circuit board and the apparatus in the fully engaged position the rigid board material places pressure on the plurality of contacts so that each contact from the plurality of contacts is pressed downward onto an electrically conducting region from the electrically conducting regions of the first printed circuit board at a pivot point on the contact, the contact pivoting around the pivot point thereby converting the downward pressure into horizontal pressure horizontally pressing the contacts to the plurality of exposed leads and thus establishing electrical contact between the contacts and the electrically conducting regions and between the contacts and the exposed leads.

6. A connector as in claim 5, wherein:

the support means comprises a first extrusion extending perpendicular to the first printed circuit board, and a second extrusion extending perpendicular to the first printed circuit board; and, each contact comprises, a first curved region upon which the rigid board material applies downward pressure when the apparatus is in the fully engaged position;

a second curved region, coupled to the first curved region, which rests upon an electrically conducting region of the first printed circuit board when the apparatus is in the fully engaged position;

a third curved region, coupled to the first curved region, which rests upon an electrically conducting region of the first printed circuit board;

a fourth curved region, coupled to the second curved region, which rests against the first extrusion;

a fifth curved regions, coupled to the third curved region, which rests against the second extrusion, a sixth curved region, coupled to the fourth curved region, which, when the printed circuit board and the apparatus are in the fully engaged position, rests against an exposed lead from the plurality of exposed leads; and, a seventh curved region, coupled to the fifth curved region, which, when the first printed circuit board and the apparatus are in the fully engaged position, rests against an exposed lead from the plurality of exposed leads.

7. A connector as in claim 5 wherein:

the support means comprises a first extrusion, the first extrusion being in contact with the rigid board material when the first printed circuit board and the apparatus are in the fully engaged position; and, the plurality of contacts is divisible into pairs of contacts, each pair of contacts comprising a first contact including a first region which is pressed by the third extrusion when the first printed circuit board and the apparatus are in the fully engaged position, a second region, coupled to the first region which is in contact with an electrically conducting region of the first printed circuit board when the first printed circuit board and the apparatus are in the fully engaged position, a third region, coupled to the second region, and a fourth region, coupled to the third region, which, when the first printed circuit board and the apparatus are in the fully engaged position, rests against an exposed lead from the plurality of exposed leads, and a second contact including a first region which is pressed by the third extrusion when the first printed circuit board and the apparatus are in the fully engaged position, a second region, coupled to the first region of the second contact, the second region of the second contact being in contact with an electrically conducting region of the first printed circuit board when the first printed circuit board and the apparatus are in the fully engaged position, a third region, coupled to the second region of the second contact, and a fourth region, coupled to the third region of the second contact, the fourth region of the second contact resting against an exposed lead from the plurality of exposed leads, when the first printed circuit board and the apparatus are in the fully engaged position.

8. A connector as in claim 5 wherein the apparatus is a cable.

9. A connector as in claim 5 wherein the apparatus is a printed circuit board coupled perpendicularly to the first printed circuit board.

10. A connector as in claim 5 wherein the apparatus includes a printed circuit board coupled in parallel to the first printed circuit board.

11. A connector as in claim 5 wherein the plurality of contacts are insulated from each other by means of a coat of insulating material placed on portions of each contact in the plurality of contacts.

12. A connector for providing electro-mechanical connection between a first printed circuit board and an apparatus, the apparatus having a plurality of exposed leads, wherein the connector comprises:

a spring connector portion including, a plurality of contacts, electrically insulated from one another, the contacts being adjacent to electrically conducting regions of the first printed circuit board, and support means (56,163,197), mechanically coupled to the first printed circuit board;

attachment means, coupled to the first printed circuit board and the apparatus, for attaching the first printed circuit board to the apparatus in a fully engaged position;

wherein the plurality of contacts, the support means, the attachment means and the plurality of exposed leads are arranged so that in the fully engaged position pressure from the attachment means results in pressure being placed on the plurality of contacts so that each contact from the plurality of contacts is pressed downward onto an electrically conducting region from the electrically conducting regions of the first printed circuit board at a pivot point on the contact, the contact pivoting around the pivot point thereby converting the downward pressure into horizontal pressure horizontally pressing the contacts to the plurality of exposed leads and thus establishing electrical contact between the contacts and the electrically conducting regions and between the contacts and the exposed leads.

13. A connector as in claim 12 wherein the apparatus is an integrated circuit.

14. A connector as in claim 12 wherein the attachment means is coupled to the leads and acts as a heat sink and RFI shield.

15. A connector as in claim 12, wherein each contact in the plurality of contacts comprises:

a first section upon which the support means places pressure;

a second section, coupled to the first section, which rests on the first printed circuit board; and, a third section, coupled to the second section in such a way that the second section is between the first section and the third section, which rests upon an exposed lead from the plurality of leads.

* * * * *